US006692008B2

(12) United States Patent
Beck

(10) Patent No.: US 6,692,008 B2
(45) Date of Patent: Feb. 17, 2004

(54) SEALING ARRANGEMENT

(75) Inventor: David A. Beck, Appleton, WI (US)

(73) Assignee: Voith Paper Patent GmbH, Heidenheim (DE)

( * ) Notice: Subject to any disclaimer, the term of this patent is extended or adjusted under 35 U.S.C. 154(b) by 179 days.

(21) Appl. No.: 10/067,157

(22) Filed: Feb. 4, 2002

(65) Prior Publication Data

US 2003/0146581 A1 Aug. 7, 2003

(51) Int. Cl.[7] ..... F16J 15/16

(52) U.S. Cl. ..... 277/500; 277/504; 277/549; 277/572; 277/581; 162/360.3; 100/155 R

(58) Field of Search ..... 277/500, 503, 277/504, 505, 549, 551, 553, 570, 1, 582, 903; 100/118, 155 R; 34/108, 111, 116, 117, 123, 242; 162/358.1, 358.2, 360.2, 360.3, 298; 193/37

(56) References Cited

U.S. PATENT DOCUMENTS

| | | | | | |
|---|---|---|---|---|---|
| 2,882,074 | A | * | 4/1959 | Charhut | 277/557 |
| 3,008,740 | A | * | 11/1961 | Hinkle, Jr. | 277/545 |
| 3,870,099 | A | * | 3/1975 | Wolodiuk | 277/385 |
| 3,875,686 | A | * | 4/1975 | Smoot | 34/242 |
| 4,398,728 | A | * | 8/1983 | Sukegawa et al. | 277/345 |
| 4,441,263 | A | * | 4/1984 | Vedenpaa | 34/115 |
| 4,811,961 | A | * | 3/1989 | Williams | 277/545 |
| 4,961,588 | A | * | 10/1990 | Brienza | 277/545 |
| 5,005,634 | A | * | 4/1991 | Reeves et al. | 165/9 |
| 5,039,115 | A | * | 8/1991 | Hebert et al. | 277/347 |
| 5,871,428 | A | * | 2/1999 | Renn et al. | 492/7 |
| 6,161,303 | A | * | 12/2000 | Beck | 34/119 |
| 6,220,600 | B1 | * | 4/2001 | Tripathy et al. | 277/309 |
| 6,422,570 | B2 | * | 7/2002 | Ikeda et al. | 277/552 |
| 6,562,198 | B2 | * | 5/2003 | Beck et al. | 162/360.3 |
| 6,589,394 | B2 | * | 7/2003 | Beck | 162/360.3 |

FOREIGN PATENT DOCUMENTS

| | | | | |
|---|---|---|---|---|
| DE | 4243828 A1 | * | 7/1994 | F16J/15/32 |
| DE | 19751283 A1 | * | 5/1999 | D21F/3/10 |
| EP | 0 069 667 A2 | | 7/1982 | |
| WO | WO 99/23296 | | 5/1999 | |

* cited by examiner

*Primary Examiner*—Anthony Knight
*Assistant Examiner*—Christopher Boswell
(74) *Attorney, Agent, or Firm*—Taylor & Aust, P.C.

(57) ABSTRACT

A sealing arrangement for closing off an end of a chamber formed between a plurality of rollers of a pressing apparatus, comprises a seal member made of a hard seal material such as carbon fiber material. The sealing arrangement is preferably a self-loaded sealing arrangement.

37 Claims, 2 Drawing Sheets

SEALING ARRANGEMENT

The present invention relates to a sealing arrangement for closing off an end of a chamber formed between a plurality of rollers of a pressing apparatus.

For some years attempts have been made to develop a new method for removing water from paper. The new method envisaged was to use compressed air to displace water from a sheet of paper. It was envisaged that a cluster of e.g. four rollers could be used to create an enclosed area that would be sealed by the four nips formed by the rollers as shown, for example, in FIG. 1. If the ends of the four rollers could be sealed off, the space between the rollers could be pressurized and this could create unique wrap processing conditions.

FIG. 1 is a schematic side view of an example of such a pressing apparatus 10 which is particularly useful in paper making. The pressing apparatus 10 comprises a plurality of rollers to define at least one chamber. In the present exemplary embodiment four rollers 12, 14, 16, 18 are provided to define one chamber 20. For convenience, sometimes rollers 14, 18 will be referred to as main rollers and rollers 12, 16 will be referred to as cap rollers.

The rollers 12, 14, 16, 18 are closed hollow cylinders. In the present exemplary embodiment roller 14 is a vented main roller.

As shown in FIG. 1, a membrane 22 travels in the direction of arrow 24 and is routed over a portion of the circumferential surface of cap roller 12, passes into inlet roller nip 26, passes over a portion of the circumferential surface of vented main roller 14 within chamber 20, passes out of outlet roller nip 28, passes over a portion of the circumferential surface of cap roller 16, and travels in the direction of arrow 30. Between the membrane 22 and the vented main roller 14, a felt 32 and the sheet 34 pass over the mentioned portion of the circumferential surface of the vented main roller 14, with the sheet 34 being disposed between the membrane 22 and the felt 32. Behind the outlet roller nip 28, in the region of cap roller 16, the felt 32 is separated from the sheet 34 which then travels together with the membrane 22 in the direction of arrow 30.

The advantages of such a configuration and its uses are many, but briefly, the rolling nips allow for a web to be passed into a pressurized area. The nips in this arrangement all turn at similar surface speeds, so that the seal created by these nips do not wear appreciatively and the web itself is not disrupted as it passes into the pressure zone. Once in the pressure zone, the web is acted upon by whatever medium that is inside the pressure zone, The pressure and speed of the system can control the needs of the process.

In general, more than four rollers could be provided and more than one chamber could be defined by these rollers.

To be able to pressurize the respective roller cluster, it is vital that there is a good seal on the ends of the rollers. The seal needs to be long-lasting and it should have low leak rates. Furthermore, it must operate under the changing pressure within the chamber formed by the respective roller cluster.

Many seal designs exist, however none is known that operates at higher speeds and pressures and has the required life.

It is an object of the present invention to provide a face sealing arrangement that closes off the end of a roller cluster press or a so-called Beck Cluster Press, allowing the press to be pressurized.

Another object of the invention is to develop a seal arrangement that has low wear and gives long life due to its low sealing pressure, Another object of the invention is to develop a self-loading and self-regulating seal arrangement that maintains low sealing pressure regardless of the pressure to be sealed.

Another object of the invention is to provide a seal arrangement that generates low heat, and that can be made in any arbitrary shape, which can be adapted to fit the unique sealing geometry of the displacement press arrangement.

Another object of the invention is to provide elements and materials that allow the seal to adapt to non-uniform sealing surfaces so that the seal can seal immediately.

Another object of the invention is to create a seal geometry that allows the seal to wear in quickly early in life yet have low wear rates after the initial seal break in.

Another object of the invention is to provide a seal arrangement which includes elements that allow for easy determination of leaks or misalignment of the sealing elements or roller ends.

Another object of the invention is to provide a sealing arrangement which allows an easily replaced seal element.

According to the invention, these and other objects are achieved by the sealing arrangement as defined in the claims.

The present invention provides a sealing arrangement for closing off an end of a chamber formed between a plurality of rollers of a pressing apparatus, wherein said sealing arrangement comprises a seal member made of hard seal material such as carbon fiber material.

Such a sealing arrangement allows minimized surface contact of the seal. With the smaller contact surfaces friction and heat are reduced. This is to be seen as a great advantage of the invention, since large contact surfaces were not desired since they create friction, and heat and add little to the seal effectiveness. Heat and friction on the other hand were detrimental and limited seal life. With the seal material being very strong, the contact area can be kept small. It was found that composite materials using carbon fiber was excellent for seal construction. By using standard carbon fiber construction techniques, a very strong surface could be created that had excellent lubrication properties. As the carbon fiber wears, the wearing materials created would tend to lubricate the seal area, extending the life of the seal. In addition, the carbon fiber seal material is inert, and can be made to withstand high temperatures, that might be experienced later a in the development of the displacement process.

The hard seal member can form a hollow body, with the wall of said hollow body being normal to the end faces of the rollers. The height of said hard seal member is preferably greater than the width of its wall.

Thus, another feature of the sealing arrangement according to the invention is the potential for long life. Since the hard seal member can be vertically orientated, i.e. be normal to the end faces of the rollers, the life of the seal depends on the height of the seal material used. The seal will run until the "wear distance" has become very small. In general terms, to increase the life of the seal by 2, e.g., this height can be increased by 2. There are practical limits to this approach, but with a corresponding arrangement, it is possible to make a very long lasting seal, since there is little to prevent one from making a very tall seal.

In accordance with a preferred embodiment the hard seal member has a seal contact surface that is about 1.02 mm to about 2.54 mm wide.

Another observation was that seal life would be greatly increased if the pressure on the sealing surface could be kept as low as possible. To create a mechanical seal, the seal must only contact the sealing surface. Any additional force beyond that required to maintain contact serves no useful purpose, and causes seal wear.

Therefore, in accordance with a preferred embodiment, the sealing arrangement is a self loaded sealing arrangement. Thus, the necessary sealing forces are generated by the seal construction itself.

The self loaded sealing arrangement may comprise a seal piston which is movable within a cylinder wall, with said seal piston comprising said hard seal member. The seal piston can have a piston ring which seals the piston to said cylinder wall yet allows the piston to remove relatively to this cylinder wall.

In accordance with a preferred embodiment said seal piston comprises a seal holder having a seal plate and an outer annular lip, and wherein said hard seal member is disposed in the region of said lip and reaches beyond said lip towards the end faces of the rollers. The lip can be defined between a slot in a preferably flat seal holder and the outer edge of this seal holder, and the hard seal member can be disposed in said slot. Apart from this, the annular lip can extend from said seal plate in the direction of the end faces of the rollers.

Thus, the seal can but must not have a raised lip. The more practical way to make the seal holder is to start with a flat sheet, and then mill a groove into it. Next, the carbon fiber and the Teflon is inserted into this groove. In this construction, the 'lip width' depends on how close to the groove is to the outside of the piece.

The milling of a single slot is much simpler than machining out the entire outside of seal holder. For small seals, a raised lip could be provided, but for a large machine, the seal could be made with a single slot around the outside of the piece.

The hard seal member can be disposed inside of the nip and abut against the seal plate. The hard seal member is preferably disposed at the inner side of the nip.

Furthermore, the seal plate can be provided with holes, so that the chamber pressure on the side of the seal plate opposite to said hard seal member is equal to the chamber pressure on the side of the seal plate on which side said hard seal member is disposed. The chamber pressure is preferably higher than the atmospheric pressure surrounding the seal piston. The surface of the seal plate exposed to the chamber pressure on the side opposite to the hard seal member is preferably greater than the surface of the seal plate exposed to the chamber pressure on the side of the hard seal member. In particular, the force loading the hard seal member can be at least partially generated by the pressure difference on the two opposite sides of the seal piston in the nip area. By increasing the thickness of the nip, the seal loading is increased, and by decreasing this thickness, the loading is decreased. The loading force created by the extra area above the seal plate that experiences higher pressure is the area of the lip times the difference in pressure across the lip. The mentioned extra area could be labeled as "approximate seal loading area". The force generated by this "approximate seal loading area" is distributed over the seal surface touching the roller ends. If the thickness of the hard sealing material is increased, the sealing force is reduced, and the seal wear is reduced as well. Thus, seal wear can be decreased by reducing the lip of the holder (denoted as "approximate seal loading area") which reduces seal load, or by increasing the thickness of the hard seal member or both. Together, these two actions will modify the pressure and the life of the seal. The direct balance of these two areas determines the life of the seal, and its effectiveness. The balance of these two factors changes depending On the seal operating pressure, and other operating characteristics.

In order for the self-loading design to work, it is necessary for the seal to make contact with the roll ends, so that pressure can be built up behind the seal. Early on, this was a problem, but this problem can be solved by the use of spring means which can, e.g., be disposed between the seal piston and a seal holder backing plate connected with the cylinder wall, The spring means are only needed to cause the seal holder piston to engage the roller ends, The spring means are not meant to provide the main sealing pressure. This is done by the pressure difference in the lip area or approximate seal loading area, as described above.

In practice, it is not always best to have a seal that gives extremely long life. Sometimes seal wear is needed so that the seal can breaking in and conform to its sealing environment. To enhance seal wear for break in, the seal contact region of the hard seal member can initially be tapered towards the end faces of the rollers to concentrate the initial sealing pressure into a smaller area and therefore to increase the initial seal wear. The increased seal wear allows the seal to initially wear in faster. As seal wear proceeds, the seal wear will reduce as the cross-section of the seal increases. Thus by using the "break in taper" the seal will quickly fit itself to its environment, as the tapered area wears, but after the tapered area is worn off, the seal will wear more slowly.

In accordance with a preferred embodiment a seal member made of a seal material softer than that of the hard seal member is disposed on the inner surface of said hard material member, with said soft seal member initially reaching beyond said hard seal member towards the end faces of the rollers. The soft seal member is preferably made of Teflon or graphite filled material.

It was found that initial seal performance can be enhanced if such soft seal material is added to the high-pressure side of the seal. Preferably, Teflon or graphite filled tape can be used to line the inner surface of the hard material member.

Since the soft seal member initially reaches beyond the hard seal member towards the end faces of the rollers, it will contact the roller ends before the hard seal member does.

The soft seal member helps by sealing gaps that are spanned by the stiff hard seal member. These gaps are very thin, yet can be easily sealed by the Teflon, which will flow into the gaps, by the action of the chamber pressure. As leakage occurs through these gaps, the Teflon will be dragged into the gaps by the leaking air, and thus the Teflon will temporarily fill the gaps. As seal wear proceeds, the carbon fiber will wear, filling the gaps and form a more lasting seal.

Spring means can be provided to independently load the soft seal member. In particular, the soft seal member can be biased towards the end faces of the rollers by spring means which can, for example, be disposed between the seal plate and the soft seal member.

This enhancement increases the adaptability of the seal. As the sealing surface changes, the spring loaded Teflon will conform to fill the gaps. However, since the Teflon wears fast, the spring force must be low or else the Teflon will wear out before the carbon fiber does.

According to another advantageous embodiment of the invention fluid lubrication is added to the sealing area. This can be done several ways. For example, the lubricant can be pumped into a cavity in the hard seal member itself. The lubricant such as water, oil or the like would escape between the seal and the sealing surface. Another way would be to apply the lubricant to the end faces of the rollers. In this case, the lubricant would stick to the rollers and be dragged underneath the seal, In all cases, the lubricant could support the seal on a film layer thereby reducing wear, friction and leakage.

By using liquids such as water to lubricate the seal, the seal wear becomes so low that it is hard to measure for this seal type. The speeds range of the seal is also increased by using water. Thus using a lubricant is an important aspect of the invention.

According to a preferred embodiment a small amount of water can be injected into the air supply line. The water then naturally sprays out at any leak point.

This method of water introduction has three advantages.

1. The seal is cooled by the water as it passes under the seal.
2. The seal is lubricated by the water
3. Air leakage is reduced, since the water interferes with air flowing through the leaks.

It has been found that some leakage is necessary to cool the seal. If there is no leakage, there can be no cooling by the lubricant, so heat builds up. To prevent seal damage, some leakage is needed. Scribing radial grooves in the ends of the rolls may be one way to provide the necessary leakage cooling. As the roll rotates, these grooves cause a deliberate leak and flow of water across the seal, as the groove passes under the seal The size of the groove is quite small, and would be of a size designed for proper cooling.

To help with the installation, startup and trouble-shooting of the seals, it has been found that lighting on the inside of the sealing contact area can be especially advantageous. By installing lights, such as LEDs on the inside of the seals, and having the lumination on the seal contact areas, it becomes easier to tell if the seal is fitted properly. The light helps to show areas where there will be leaks. If the ambient light level is low enough, the light inside the chamber area leaks out and illuminates gaps and areas where leakage will occur. With lights installed of a special color, such as, for example, red, it becomes easy to look for leaks by looking for red light leakage.

In accordance with an advantageous embodiment at least one mechanical stop is provided to prevent the seal piston from further advancing to the end faces of the rollers when the wear distance has reached a defined small value.

First, in order to prevent damage to the roller ends, when the seal material runs out, it is anticipated that the mechanical stops and springs will prevent the seal from advancing to the roll end, when the wear distance is small. This is a preferred safety feature of the sealing arrangement, which prevents damage to the roller ends once the seal is worn out.

In accordance with an advantageous embodiment the seal piston comprises a portion of non-abrasive material which contacts the end faces of the rollers when the hard seal member is worn out. Preferably the contacting material would touch the end faces of the rollers in a non-critical area, so that the roll end is not damaged.

According to another advantageous embodiment alarm means as preferably sound-making means can be provided to signalize that the hard seal member is worn out and needs replacing The sound could, e.g., be created in a manner similar to that used for auto-disk brakes, where the brake pads give a high pitch sound when they are worn out.

The seal holder is preferably made of metal.

The hard seal member preferably comprises at least one layer of carbon fiber material, the fibers of which are running in a direction perpendicular to the end faces of the rollers, said layer being adhered to the inner side of the lip and the thickness of said layer being preferably about 0.18 mm. Furthermore, the hard seal member can further comprise at least one layer of carbon fiber material, the fibers of which are running in the circumferential direction, said further layer preferably being made of prepreg carbon fiber material or otherwise such as, for example, by using carbon fiber laminate or by using molding techniques with or without carbon fiber or by using ceramics.

Thus, as to the seal construction materials, other forms than prepreg carbon fiber can be used as well. For example, carbon fiber laminate can be used. Also, molding techniques can be used for making the seal—with or without carbon fiber Finally, there are classes of seals that use ceramics in their construction. These seals have a very long life, so the use of ceramic is also possible.

Preferably, the hard seal member further comprises a final layer of carbon fiber material the fibers of which are running in a direction perpendicular to the end faces of the rollers. In accordance with a preferred embodiment the soft seal member is added to the inner side of the final layer of the such formed hard seal member.

Thus, an advantageous construction of the sealing arrangement can be achieved, for example, as follows:

A successful seal design has been by using a metal seal holder which has carbon fiber and Teflon built up on the inner wall of the seal holder. Several methods can be used to made the seal, for example, uni-directional carbon fiber laminate can be purchased in a thickness of 0.18 mm (0.007 inches). This can be cut in strips with the fibers running perpendicular to the length of the strip. The strip is then coated on one side with adhesive and is wound inside the metal holder. Inside tight fitting forms can be inserted to hold the carbon fiber in place, while the adhesive dries. One or more layers of carbon fiber can be built up on the inside of the seal. This layer gives the seal strength from blow out failure, and the strength of these fibers determines to a large extent, how high the seal can be made, and thus, how long the seal will last.

Next, strips of carbon fiber are cut with the fibers aligned in the length direction. Prepreg carbon fiber can be used for this layer, which allows longer working time. Once the layers are built up, a final layer of carbon fiber with the fibers perpendicular to the length can be added. Inside of these layers, tight fitting forms can be added, to compress the fibers together so that a good adhesive bond is made. Once assembled, the entire structure can be placed in an oven to cure the prepreg epoxy. When this operation is finished, the seal can be sanded flat, and the Teflon or graphite tapes or other soft material can be added to the inside of the seal.

It has been found the best shape for the seal to be "dog bone" shaped. To close off the roll ends for pressurization, the seal must contact all, e.g. four, rolls. In addition, the seal must pass between rolls at the nip points. These conditions must be met for the seal to prevent leakage from the pressure chamber. It is desirable to have the least force possible on the seal holder backing plate. Obviously the lower the force, the simpler and cheaper the structure to support the backing plate. Since the force on the backing plate is a product of the backing plate surface area, and the chamber pressure, these forces can be reduced by making the surface area the minimum needed. The minimum needed area is the outline of the pressure chamber, but for practicality, the seal shape must be a little larger than this so that the seal alignment with the chamber is not critical.

Another factor related to this shape has to do with the forces and methods for making the seal. The e.g. four sharp points of the chamber are difficult to construct with a single ribbon of carbon fiber. The carbon fiber, being a stiff material, can only be bent around a curve with a certain minimum radius. If it were bent around a tighter curve than this radius, the fibers would break. Thus, the minimum bending radius limits the sharpest bend that can be used to fabricate the seal shape.

All of these factors taken together give the above-mentioned 'dog bone' shape.

As to the seal mounting, seal replacement should preferably be made as simple as possible. One way to do this is to make it easy to replace the seal. To do this, the seal could be modified so that the wearing parts can bolt into the seal assembly. The seal plate, and its carbon fiber/Teflon parts could be a single unit that can bolt into the piston, spring and stops that are part of the rest of the seal assembly. There is no need to disassemble the entire seal, just to replace the wearing part.

Having regard to advantageous developments of the invention reference should be made to the subordinate claims and also to the subsequent description of embodiments of a sealing arrangement in accordance with the invention, with reference to the accompanying drawings, wherein:

FIG. 2 is a partial sectional view of an exemplary embodiment of a sealing arrangement 36 of the invention for closing off an end of a chamber formed between a plurality of rollers of a pressing apparatus, for example such a pressing apparatus as described above in connection with FIG. 1.

Figure 1:
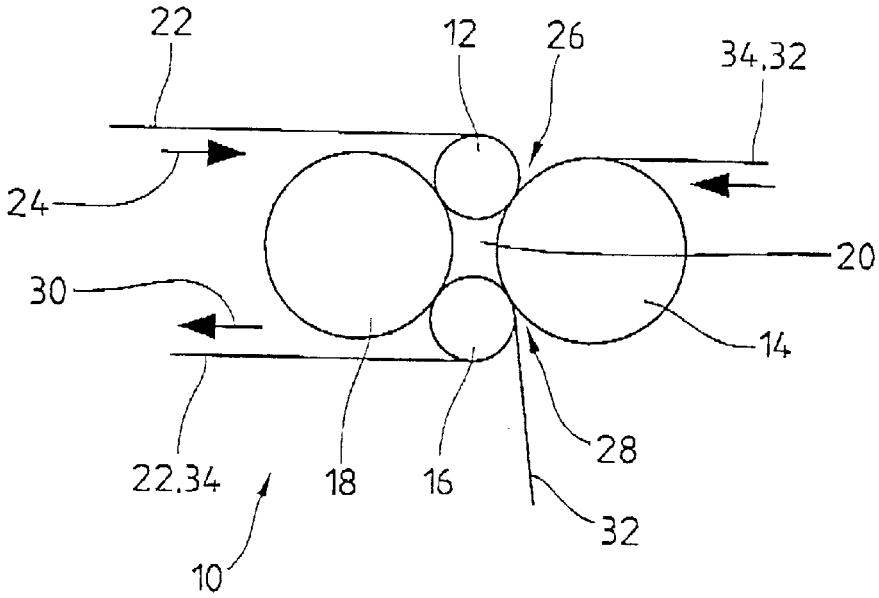
FIG. 1 is a schematic side view of an example for a pressing apparatus which comprises a plurality of rollers defining a chamber.
Figure 2:
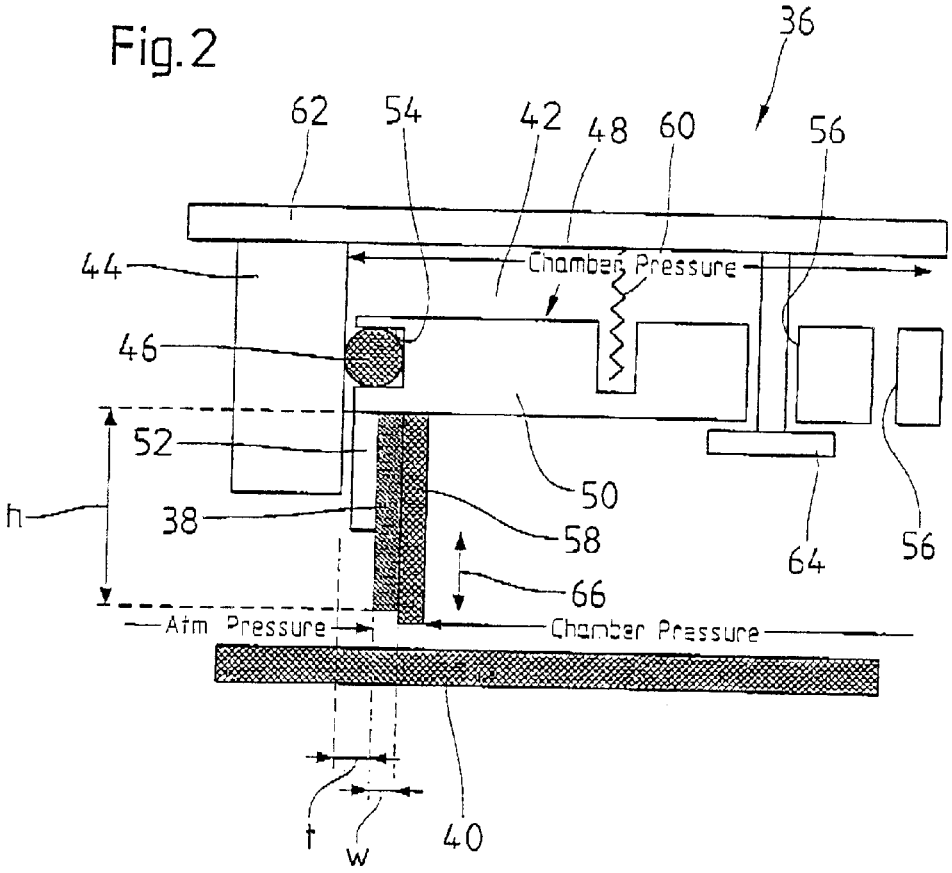
FIG. 2 is a partial sectional view of an exemplary embodiment of a sealing arrangement in accordance with the invention which can be used, for example, to close off an end of the chamber of the pressing apparatus of FIG. 1.

As shown in FIG. 2, the sealing arrangement 36 comprises a seal member 38 made of hard seal material such as carbon fiber material. The hard seal member 38 forms a hollow body, the wall of which is normal to the end faces 40 of the rollers. The seal can, e.g., be "dog bone" shaped.

The height h of the hard seal member 38 is greater than the width w of its wall and thus of its seal contact surface. The seal contact surface of the hard seal member 38 can, for example, be about 1.02 mm to about 2.54 mm wide.

The sealing arrangement 36 is a self-loaded sealing arrangement which comprises a seal piston 42 which is movable within a cylinder wall 44. This seal piston 42 comprises said hard seal member 38.

As shown in FIG. 2, the seal piston 42 has a piston ring 46 which seals the piston 42 to the cylinder wall 44 yet allows the piston 42 to move relative to this cylinder wall 44.

The seal piston 42 comprises a seal holder 48, having a seal plate 50 and an outer annular lip 52. The piston ring 46 is disposed in a circumferential groove 54 of said seal plate 50. The annular lip 52 extends from the seal plate 50 in the direction of the end faces 40 of the rollers.

The hard seal member 38, which is disposed in the region of the lip 52, reaches beyond said lip 52 towards the end faces 40 of the rollers. In the present case, the hard seal member 38 is disposed on the inner side of the lip 52 and abuts against the seal plate 50.

As shown in FIG. 2, the seal plate 50 is provided with holes 56, so that the chamber pressure on the side of the seal plate 50 opposite to the hard seal member 38 is equal to the chamber pressure on the side of the seal plate 50 on which side the hard seal member 38 is disposed. The chamber pressure on the two opposite sides of the seal plate 50 is higher than the atmospheric pressure surrounding the seal piston 42.

On the lower end of the seal piston 42, the hard seal member 38 of carbon fiber material is shown which is pressed into the roller ends creating the seal.

As mentioned above, the chamber pressure is higher than the atmospheric pressure surrounding the seal. As shown in FIG. 2, due to the holes 56 in the seal holder 48, the chamber pressure is experienced above and below the seal holder 48. The areas seeing chamber pressure above and below the seal holder 48 however are not equal. Above the seal plate 50 of said seal holder 48, the chamber pressure region extends to the cylinder wall 44. This is shown by the upper arrow in FIG. 2. Below the seal plate 50, the chamber pressure region extends to the edge of a soft seal member 58 disposed on the inner side of the hard seal member 38. The lower arrow in FIG. 2 shows this.

Because of the lip 52 of the seal plate 50, there is an extra area 74 above the seal plate 50 that experiences higher pressure than the area below the plate. This area 74 defines an "approximate seal loading area". Because of the imbalance in pressure across this area, i.e. chamber pressure above and atmospheric pressure below, this small area creates the force necessary to load the seal into the roll ends. By increasing the thickness t of this lip 52, the seal loading is increased and by decreasing this thickness t, the loading is decreased. The loading force created by this area is the area of the lip 52 times the difference in pressure across the lip 52.

The force generated by the "approximate seal loading area" is distributed over the seal surface touching the end faces 40 of the rollers. If the thickness or width w of the hard seal member 38 is increased, the sealing force is reduced, and the seal wear is reduced as well. The seal wear can be decreased by reducing the thickness t of the lip 52 of the seal holder 48 (denoted as "approximate seal loading area") which reduces seal load, or by increasing the width of the hard seal member 38 or both. Together, these two actions will modify the pressure and the life of the seal. The correct balance of these two areas determines the life of the seal, and its effectiveness. The balance of these two factors changes depending on the seal operating pressure, and other operating characteristics.

The seal piston 42 can be biased towards the end faces 40 of the rollers by spring means 60.

The seal member 58 made of a seal material softer than that of the hard seal member 38 is disposed on the inner surface of the hard seal member 38. This soft seal member 58 initially reaches beyond the hard seal member 38 towards the end faces 40 of the rollers. In the present embodiment, the soft seal member 58 abuts with its other end against the seal plate 50.

The soft seal member 58 added to the high-pressure side of the hard seal member 38 can be made of Teflon or graphite filled material. In particular, Teflon or graphite filled tape can be used to line the inner surface of the hard seal member 38. As mentioned above, the soft seal member 58 can be configured to extend below the lower surface of the hard seal member 38 made of carbon fiber, so that the soft seal member 58 will contact the end faces 40 of the rollers before the hard seal member 38 does.

The soft seal member 58 helps by sealing gaps that are spanned by the stiff carbon fiber seal member 38. These gaps are very thin, yet can be easily sealed by the Teflon, which flows into the gaps, by the action of the chamber pressure. As leakage occurs through these gaps, the Teflon will be dragged into the gaps by the leaking air, and thus, the Teflon will temporarily fill the gaps. As seal wear proceeds, the carbon fiber wears, filling the gaps and forming a more lasting seal.

As shown in FIG. 2, the spring means 60 are disposed between the seal piston 42 (i.e. the seal plate 50) and a seal holder backing plate 62 connected with the wall 44.

The spring means 60 are only needed to cause the seal piston 42 to engage the end faces 40 of the rollers. The spring means 60 are not meant to provide the main sealing pressure. This main sealing pressure is provided by the pressure difference on the two opposite sides of the seal plate 50, as described above.

At least one mechanical stop 64 is provided to prevent the seal piston 42 from further advancing to the end faces 40 of the rollers when the wear distance 66 has reached a defined small value, The seal piston 42 may comprise a portion of non-abrasive material which preferably contacts the end faces 40 of the rollers in a non-critical area when the hard seal member 38 is worn out.

As shown in FIG. 2, the mechanical stop 64 may be connected with the seal holder backing plate 62 and pass through a hole 56 provided in the seal plate 50.

Thus, in order to prevent damage to the roller ends, when the seal material runs out, it is anticipated that the mechanical stops 64 and spring means 60 will prevent the seal from advancing to the end faces 40 of the rollers, when the wear distance 66 is small. This is a safety feature of this design, which prevents damage to the roller ends once the seal is worn out. The effect of this design is that the seal will start to leak a lot when the seal is worn out, rather than damage the roll ends. As a further safety measure to prevent roll end wear, the seal can, as mentioned above, be made with non-abrasive materials, that contact the roll ends when the seal life is up, Preferably the contacting material will touch the roll in a non-critical area, so that the end faces of the rollers 40 are not damaged.

The seal holder 48 can be made of metal.

Figure 3:
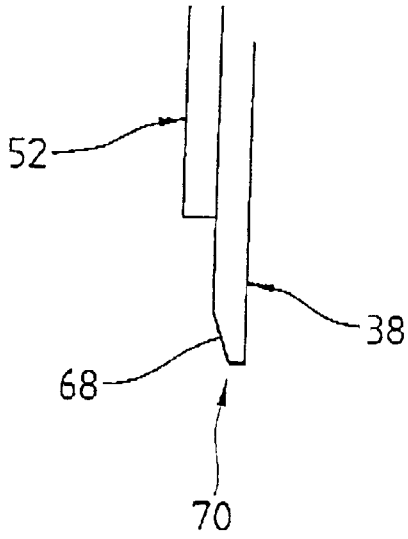
FIG. 3 is a partial sectional view of another embodiment of the hard seal member of the sealing arrangement of FIG. 2.

For example, it is not always best to have a seal that gives extremely long life. Sometimes seal wear is needed so that the seal can break in and conform to its sealing environment. To enhance seal wear for a break in, the seal geometry can be modified as shown in FIG. 3. In this FIG. 3, the hard seal member 38 has a tapered surface 68 that concentrates the sealing pressure into a small area. The increased seal pressure increases seal wear, and thus allows the seal to initially wear in faster. As seal wear proceeds, the seal wear will reduce when the cross-section of the seal increases. Thus, by using the "break in taper" or tapered seal contact region 70 the seal will quickly fit itself to its environment, as the tapered area wears, but after the tapered area is worn off, the seal will wear more slowly.

The soft seal member 38 having the tapered surface 68 is again disposed on the inner side of the lip 52.

Figure 4:
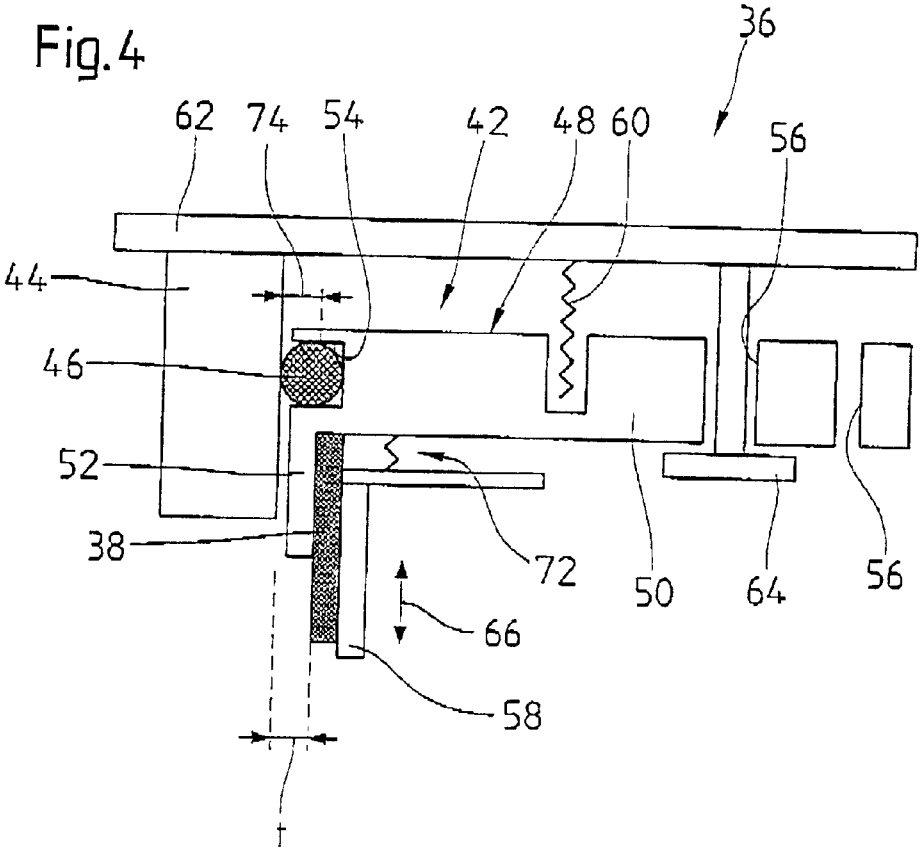
FIG. 4 is a partial sectional view of another exemplary embodiment of a sealing arrangement in accordance with the invention.

FIG. 4 is a partial sectional view of another exemplary embodiment of a sealing arrangement 36 in accordance with the invention which embodiment includes some modifications as compared with the embodiment of FIG. 2.

As shown in FIG. 4, spring means 72 are provided to independently load the soft seal member 58. The spring means 72 are disposed between the seal plate 50 and the soft seal member 58. This enhancement increases the adaptability of the seal. As the sealing surface changes, the spring loaded soft seal member 58 will confirm to fill the gaps. However, since the Teflon wears fast, the spring force must be low or else the Teflon will wear out before the carbon fiber hard seal member 38 does.

Apart from the above-mentioned modification, this embodiment of FIG. 4 can have at least essentially the same structure as the embodiment as depicted in FIG. 2. Corresponding elements are denoted with the same reference numerals.

Fluid lubrication can be added to the sealing area. The respective lubricant can be pumped into a cavity in the hard seal member 38 or be applied to the end faces 40 of the rollers. In the latter case, the lubricant will stick to the roll end and be dragged underneath the seal. In all cases, the lubricant could support the seal on a film layer thereby reducing wear, friction and leakage.

Lighting on the inside of the sealing contact can be provided for leakage detection. For example, for such a leakage detection LEDs for emitting light of a defined color can be provided to illuminate the seal contact area. Additionally or alternatively alarm means for making a sound could be provided to signalize that the hard seal member 38 is worn out and needs replacing.

A preferred construction of the seal is as follows.

The most successful seal design has been by using a metal seal holder which has carbon fiber and Teflon built up on the inner wall of the seal holder. Several methods can be used to make the seal, for example, uni-directional carbon fiber laminate can be purchased in a thickness of 0.007". This can be cut in strips, with the fibers running perpendicular to the length of the strip. The strip is then coated on one side and is wound inside the metal holder. Inside tight fitting forms can be inserted to hold the CF (carbon fiber) in place while the adhesive dries. One or more layers of CF can be built up on the inside of the seal. This layer gives the seal strength from blow out failure, and the strength of these fibers determines to a large extent, how high the seal can be made, and thus, how long the seal will last.

Next, strips of CF are cut with the fibers aligned in the length direction. Prepreg CF can be used for this layer, which allows longer working time. Once the layers are built up, a final layer of CF with the fibers perpendicular to the length can be added. Inside of these layers, tight fitting forms can be added, to compress the fibers together so that a good adhesive bond is made. Once assemble, the entire structure can be placed in an oven to cure the adhesive. When this operation is finished, the seal can be sanded flat, and the Teflon or graphite tapes or other soft material can be added to the inside of the seal.

LIST OF REFERENCE NUMERALS

10 pressing apparatus
12 roller, cap roller
14 roller, vented main roller
16 roller, cap roller
18 roller, main roller
20 chamber
22 membrane
24 arrow
26 inlet roller nip
28 outlet roller nip
30 arrow
32 felt
34 sheet
36 sealing arrangement
38 hard seal member
40 end faces of the rollers
42 seal piston
44 cylinder wall
46 piston ring
48 seal holder
50 seal plate

52 lip
54 groove
56 hole
58 soft seal member
60 spring means
62 seal holder backing plate
64 mechanical stop
66 wear distance
68 tapered surface
70 break in taper, tapered seal contact region
72 spring means
74 approximate loading area
h height
t thickness
w width

What is claimed is:

1. A sealing arrangement (36) for closing off an end of a chamber formed between a plurality of rollers of a pressing apparatus, wherein said sealing arrangement (36) comprises a seal member (38) made of hard seal material comprised of carbon fiber material.

2. The sealing arrangement of claim 1, wherein said hard seal member (38) forms a hollow body, with the wall of said hollow body being normal to the end faces (40) of the rollers.

3. The sealing arrangement of claim 2, wherein the height h of said hard seal member (38) is greater than the width (w) of its wall.

4. The sealing arrangement of claim 1, wherein the hard seal member (38) has a seal contact surface that is about 1.02 mm to about 2.54 mm wide.

5. The sealing arrangement of claim 1, wherein said sealing arrangement (36) is a self loaded sealing arrangement.

6. The sealing arrangement of claim 5, wherein said sealing arrangement (36) comprises a seal piston (42) which is moveable within a cylinder wall (44), with said seal piston (42) comprising said hard seal member (38).

7. The sealing arrangement of claim 6, wherein the seal piston (42) has a piston ring (46) which seals the piston (42) to the cylinder wall (44) yet allows the piston (42) to move relative to this cylinder wall (44).

8. The sealing arrangement of claim 6, wherein said seal piston (42) comprises a seal holder (18) having a seal plate (50) and an outer annular lip (52), and wherein said hard seal member (38) is disposed in the region of said lip (52) and reaches beyond said lip (52) towards the end faces (40) of the rollers.

9. The sealing arrangement of claim 8, wherein said lip (52) is defined between a slot in a preferably flat seal holder and the outer edge of this seal holder, and wherein said hard seal member (38) is disposed in said slot.

10. The sealing arrangement of claim 8, wherein said annular lip (52) extends from said seal plate (50) in the direction of the end faces (40) of the rollers.

11. The sealing arrangement of claim 1, wherein said hard seal member (38) is disposed inside an lip (52) or inserted into the slot, respectively, and abuts against the seal plate (50).

12. The sealing arrangement of claim 11, wherein said hard seal member is disposed at the inner side of the lip (52).

13. The sealing arrangement of claim 8, wherein said seal plate (50) is provided with holes (56) so that the chamber pressure on the side of the seal plate (50) opposite to said hard seal member (38) is equal to the chamber pressure on the side of the seal plate (50) on which side said hard seal member (38) is disposed, and wherein said chamber pressure is higher than the atmospheric pressure surrounding said seal piston (42).

14. The sealing arrangement of claim 8, wherein the surface of the seal plate (50) exposed to said chamber pressure on the side opposite to said hard seal member (38) is greater than the surface of the seal plate (50) exposed to said chamber pressure on the side of the hard seal member (38).

15. The sealing arrangement of claim 14, wherein the force loading said hard seal member (38) is at least partially generated by the pressure difference on the two opposite sides of the seal piston (42) in the lip area.

16. The sealing arrangement of claim 6, wherein said seal piston (42) is biased towards said end faces of the rollers by spring means (60).

17. The sealing arrangement of claim 16, wherein said spring means (60) are disposed between said seal piston (42) and a seal holder backing plate (62) connected with said wall (44).

18. The sealing arrangement of claim 1, wherein the seal contact region (70) of said hard seal member (38) is initially tapered towards said end faces (40) of the rollers to concentrate the initial sealing pressure into a smaller area and therefore to increase the initial seal wear.

19. The sealing arrangement of claim 1, wherein a seal member (58) made of a seal material softer than that of the hard seal member (38) is disposed on the inner surface of said hard seal member (38), with said soft seal member (58) initially reaching beyond said hard seal member (38) towards the end faces (10) of the rollers.

20. The sealing arrangement of claim 19, wherein said soft seal member (58) is made of Teflon or graphite filled material.

21. The sealing arrangement of claim 20, wherein said soft seal member (58) is made of a Teflon or graphite filled tape provided to line the inner surface of said hard material member (38).

22. The sealing arrangement of claim 19, wherein said soft seal member (58) is biased towards said end faces (40) of the rollers by spring means.

23. The sealing arrangement of claim 22, wherein said spring means (72) are disposed between said seal plate and said soft seal member (58).

24. the sealing arrangement of claim 19, wherein fluid lubrication, is added to the sealing area.

25. The sealing arrangement of claim 24, wherein the lubricant is pumped into a cavity in said hard seal member (38).

26. The sealing arrangement of claim 24, wherein the lubricant is applied to said end faces (40) of the rollers.

27. The sealing arrangement of claim 24, wherein the lubricant is injected into an air supply line for the chamber.

28. The sealing arrangement of claim 18, wherein lighting on the inside of the sealing contact area is provided.

29. The sealing arrangement of claim 28, wherein LEDs for emitting light of a defined color are provided to illuminate the seal contact area.

30. The sealing arrangement of claim 16, wherein at least one mechanical stop (64) is provided to prevent said seal piston (42) from further advancing to the end faces (40) of the rollers when the wear distance (66) has reached a defined small value.

31. The sealing arrangement of claim 16, wherein said seal piston (42) comprises a portion of non-abrasive material which preferably contacts the end faces (40) of the rollers in a non-critical area when the hard seal member (38) is worn out.

32. The sealing arrangement of claim 31, wherein alarm means are provided to signalize that the hard seal member (38) is worn out and needs replacing.

33. The sealing arrangement of claim 31, wherein said seal holder (48) is made of metal.

34. The sealing arrangement of claim 31, wherein said hard seal member (38) comprises at least one layer of carbon fiber material, the fibers of which are running in a direction perpendicular to the end faces (40) of the rollers, said layer being adhered to the inner side of the lip (52) and the thickness of said layer being preferably about 0.18 mm.

35. The sealing arrangement of claim 34, wherein said hard seal member (38) further comprises at least one layer of carbon fiber material, the fibers of which are running in the circumferential direction, said further layer comprised of prepreg carbon fiber material by using carbon fiber laminate or by using molding techniques with or without carbon fiber or by using ceramics.

36. The sealing arrangement of claim 35, wherein said hard seal member (38) further comprises a final layer of carbon fiber material the fibers of which are running in a direction perpendicular to the end faces (40) of the rollers.

37. The sealing arrangement of claim 35, wherein said soft seal member (58) is added to the inner side of said final layer of said hard seal member (38).

* * * * *